US006336732B1

(12) United States Patent
Shiau

(10) Patent No.: US 6,336,732 B1
(45) Date of Patent: Jan. 8, 2002

(54) FLASHLIGHT WITH A WATERPROOF SWITCHING DEVICE

(76) Inventor: Shoei-Shuh Shiau, No. 10, Alley 1, Lane 551, Sec.1, Wan-Shou Rd., Kuei-Shan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/613,869

(22) Filed: Jul. 11, 2000

(30) Foreign Application Priority Data

Dec. 23, 1999 (TW) ..... 88221936

(51) Int. Cl.[7] ..... F21L 4/00
(52) U.S. Cl. ..... 362/205; 362/202; 362/267
(58) Field of Search ..... 362/158, 202, 362/205, 206, 267, 208; 200/60, 302.2

(56) References Cited

U.S. PATENT DOCUMENTS 3,924,116 A * 12/1975 Brindley ..... 362/158
4,940,860 A 7/1990 Shiau ..... 200/60
5,967,642 A * 10/1999 Chiu ..... 362/205

* cited by examiner

*Primary Examiner*—Y. My Quach-Lee
(74) *Attorney, Agent, or Firm*—Foley & Lardner

(57) ABSTRACT

A flashlight includes a switch housing mounted in a barrel which is formed with a radial switch opening. The switch housing defines a button hole aligned with the switch opening in the barrel. The button hole has a large-diameter hole portion proximate to the switch opening, and a small-diameter hole portion distal to the switch opening. A button switching element is mounted in the switch housing, and has a button-confining sleeve and a button movably confined by the sleeve. The sleeve and the button extend through the small-diameter hole portion and into the large-diameter hole portion of the button hole. A resilient sealing member is disposed in a first annular clearance defined between the sleeve and the large-diameter hole portion of the button hole. The sealing member has an operating portion projecting into the switch opening of the barrel, a tubular portion enclosing the button and the sleeve, and a peripheral flange portion extending into the large-diameter hole portion of the button hole. A retaining ring is fittingly disposed in a second annular clearance defined between the tubular portion of the sealing member and the large-diameter hole portion of the button hole so as to urge the tubular portion of the sealing member to contact the sleeve tightly to thereby forming a watertight seal therebetween.

4 Claims, 5 Drawing Sheets

FLASHLIGHT WITH A WATERPROOF SWITCHING DEVICE

BACKGROUND OF THE INVENTION

1. Field of the Invention

The invention relates to a flashlight, more particularly to a flashlight having a waterproof switching device.

2. Description of the Related Art

Referring to FIGS. 1 and 2, a flashlight according to U.S. Pat. No. 4,940,860 is shown to include a barrel 1 and a waterproof switching device. As illustrated, the barrel 1 is formed with a radial switch opening 15. The waterproof switching device includes a switch housing 10, and a push-button switching element 12. The switch housing 10 is formed with a radial button hole 13 that is aligned with the radial switch opening 15 and that has a large-diameter hole portion 130 proximate to the switch opening 15, and a small-diameter hole portion 131 that is distal to the switch opening 15, and an annular shoulder 14 that is defined between the large-diameter hole portion 130 and the small-diameter hole portion 131, and that is located at one end of the button hole 13 which is distal to the switch opening 15. The large-diameter hole portion 130 is confined by a hole-defining surface. The push-button switching element 12 is mounted in the switch housing 10, and has a button-confining sleeve 120 and a button 121 movably confined by the button-confining sleeve 120. The button-confining sleeve 120 and the button 121 extend through the small-diameter hole portion 131 and into the large-diameter hole portion 130 of the button hole 13. The annular shoulder 14 cooperates with the hole-defining surface confining the large-diameter hole portion 130 of the button hole 13 to form an annular clearance. A resilient sealing member is disposed in the annular clearance, and has an operating portion 17 that projects into the switch opening 15 and that encloses the button 121 and the button-confining sleeve 120 therein, and an annular flange portion 18 that extends to the hole-defining surface confining the large-diameter hole portion 130 of the button hole 13 so as to establish watertight seal between the barrel 1 and the annular shoulder 14.

Some of the disadvantages of the aforesaid conventional switching device are as follows:

During assembly of the switching device on the barrel 1, the flange portion 18 of the sealing member must be inserted from an exterior of the barrel 1 into the annular clearance via the switching opening 15 so that the operating portion 17 is exposed from the barrel 1. As such, a void may be formed among the flange portion 18, the shoulder 14, and an inner barrel surface 16 of the barrel 1, thereby rendering the switching device non-waterproof. In addition, since no immobilizing device is applied between the inner barrel surface 16 of the barrel 1 and the switch housing 10, replacement of battery may result in displacement of the switching housing 10 relative to the barrel 1, which will affect the waterproofing effect of the switching device.

SUMMARY OF THE INVENTION

Therefore, the object of this invention is to provide a flashlight with a waterproof switching device which is clear of the disadvantages mentioned beforehand.

Accordingly, the flashlight of the present invention includes a barrel formed with a radial switch opening, and a waterproof switching device. The switching device includes a switch housing mounted in the barrel and formed with a radial button hole that is aligned with the radial switch opening and that has a large-diameter hole portion proximate to the switch opening, a small-diameter hole portion that is distal to the switch opening, and an annular shoulder that is defined between the large-diameter and small-diameter hole portions and that is formed at one end of the button hole which is distal to the switch opening. The large-diameter hole portion is confined by a hole-defining surface. A push-button switching element is mounted in the switch housing, and has a button-confining sleeve and a button movably confined by the button-confining sleeve. The button-confining sleeve and the button extend through the small-diameter hole portion and into the large-diameter hole portion of the button hole. The button-confining sleeve cooperates with the hole-defining surface confining the large-diameter hole portion of the button hole to form a first annular clearance. A resilient sealing member is disposed in the first annular clearance, and has an operating portion that projects into the switch opening, a tubular portion that extends from the operating portion and that encloses the button and the button-confining sleeve, and a peripheral flange portion that extends from one end of the tubular portion proximate to the shoulder and that extends to the hole-defining surface confining the large-diameter hole portion of the buttonhole. The tubular portion of the sealing member cooperates with the hole-defining surface confining the large-diameter hole portion of the button hole to form a second annular clearance. A retaining ring is fittingly disposed in the second annular clearance so as to urge the tubular portion of the sealing member to contact tightly the button-confining sleeve of the switching element, and so as to urge the peripheral flange portion of the sealing member toward the shoulder.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Referring to FIGS. 3, 4, 5 and 6, the preferred embodiment of a flashlight of this invention is shown to include an electrically conductive barrel 2, and a switching device.

Figure 1:
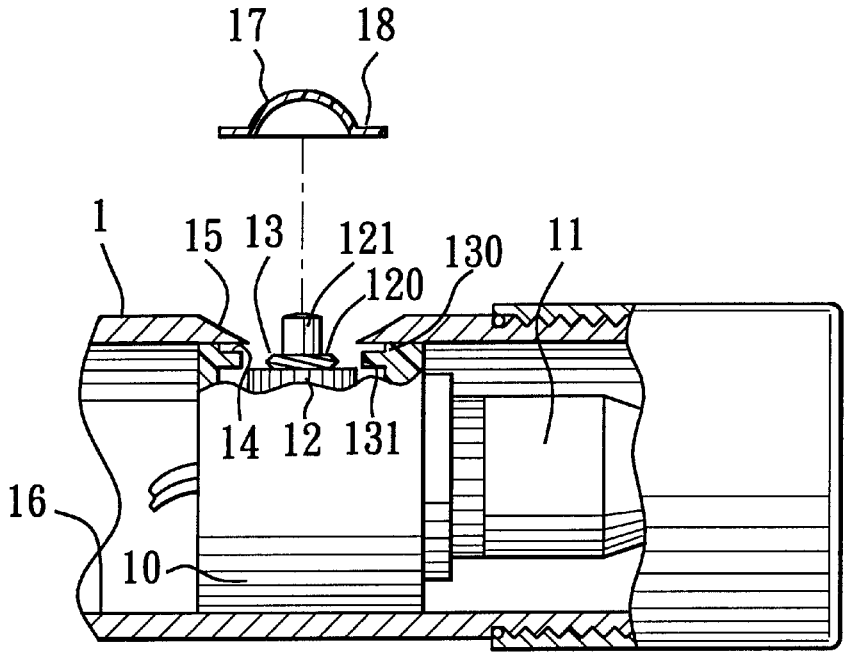
FIG. 1 PRIOR ART
FIG. 1 is a fragmentary and partly exploded view of a flashlight disclosed in U.S. Pat. No. 4,940,860.
Figure 2:
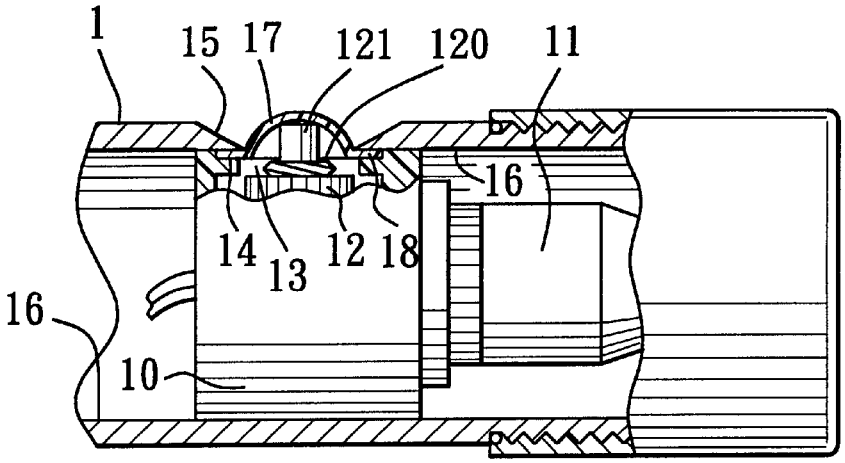
FIG. 2 PRIOR ART
FIG. 2 is a fragmentary sectional view of the flashlight shown in FIG. 1.
Figure 3:
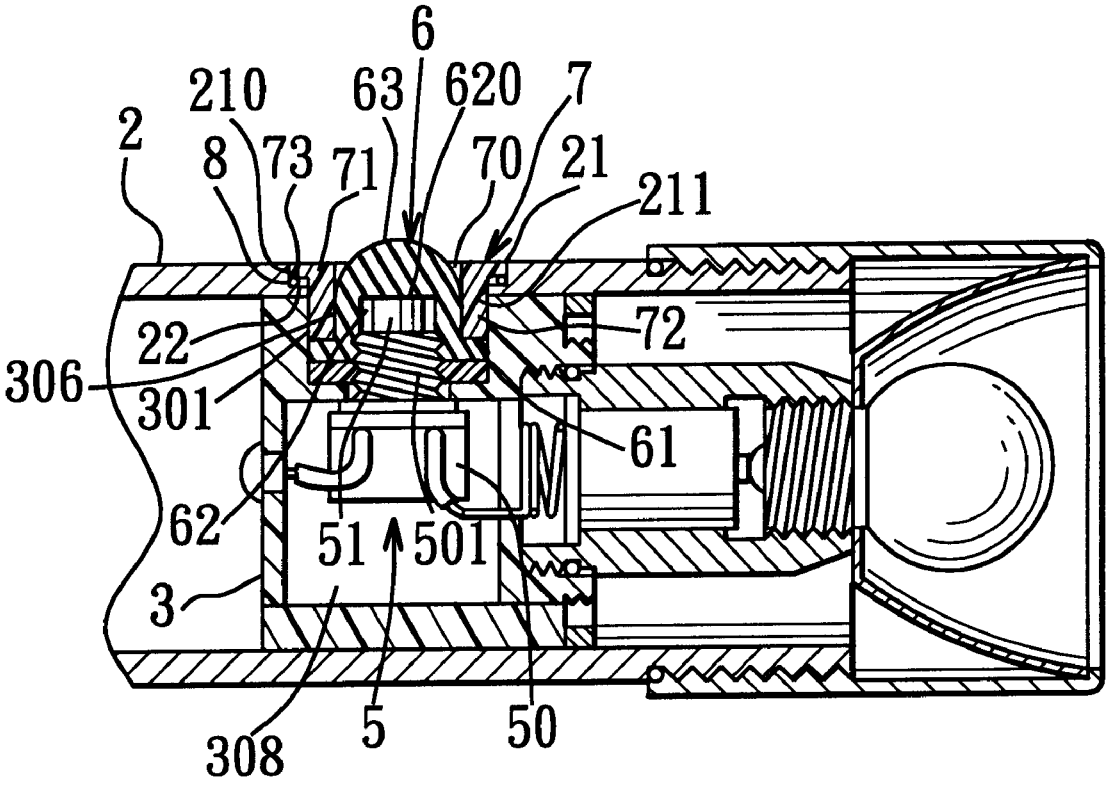
FIG. 3 is a fragmentary, sectional view of the preferred embodiment of a flashlight according to the present invention.
Figure 4:
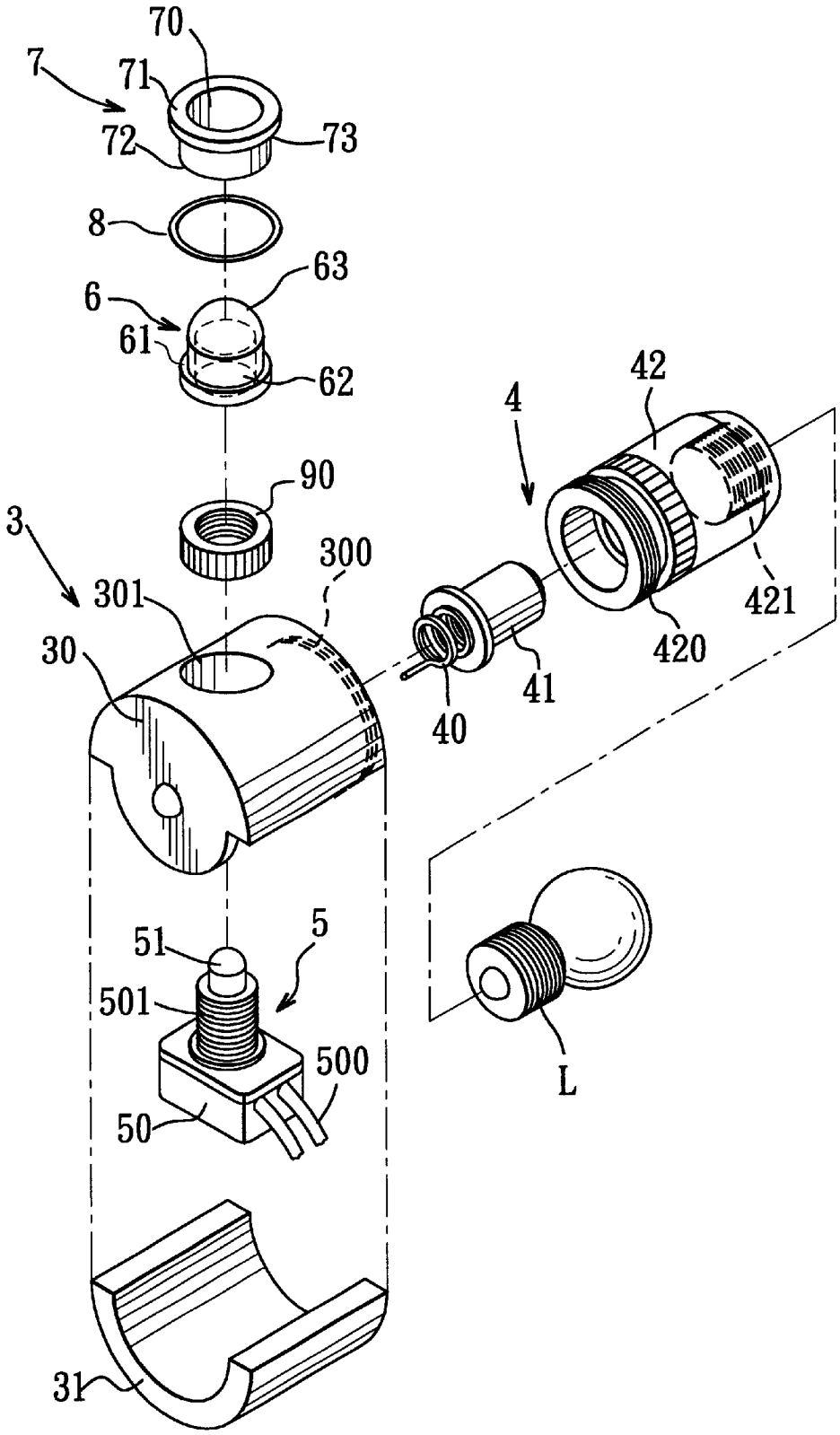
FIG. 4 is an exploded view of a waterproof switching device employed in the preferred embodiment.
Figure 5:
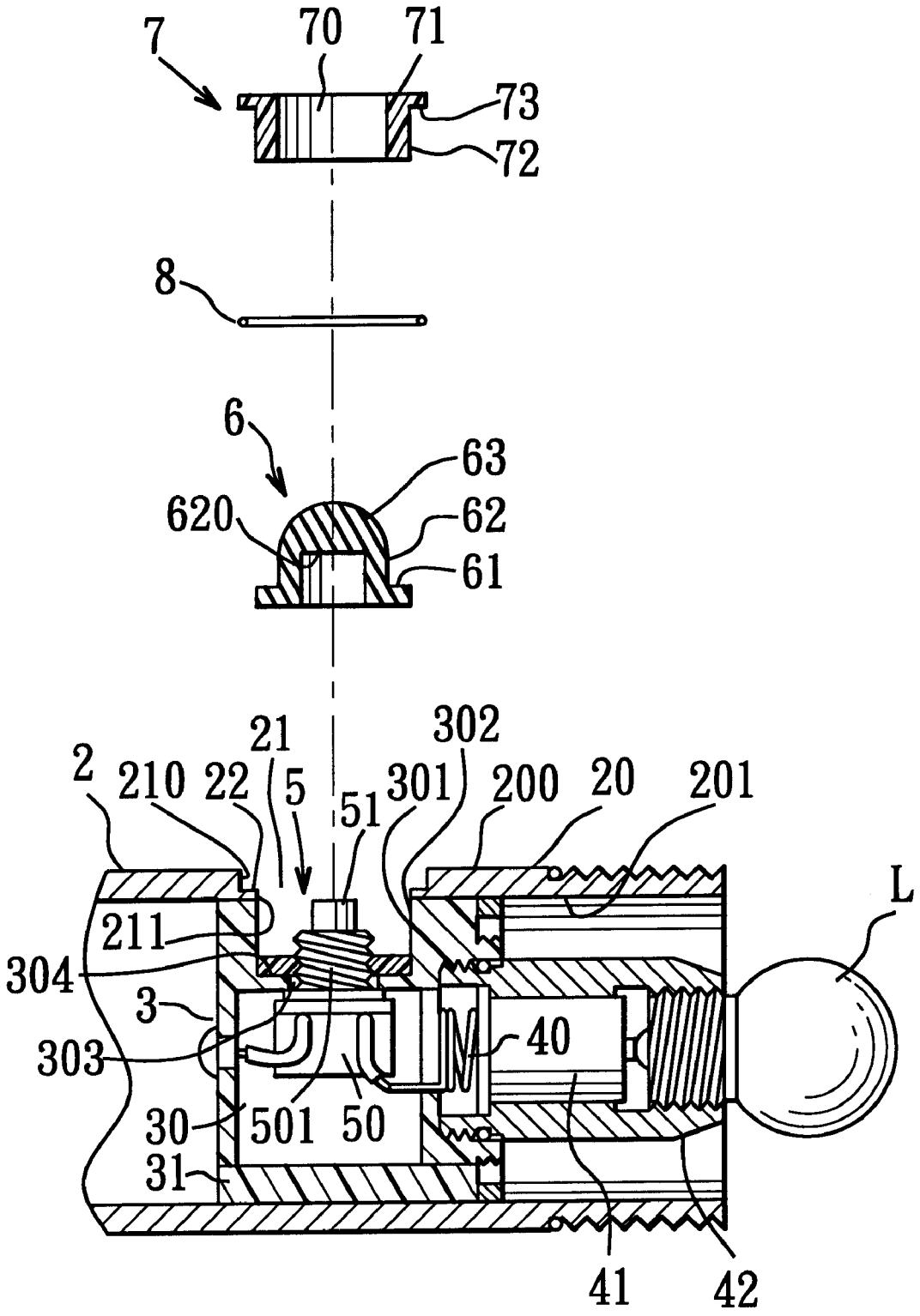
FIGS. 5 and 6 illustrate how the waterproof switching device is mounted on a barrel in order to form the preferred embodiment.
Figure 6:
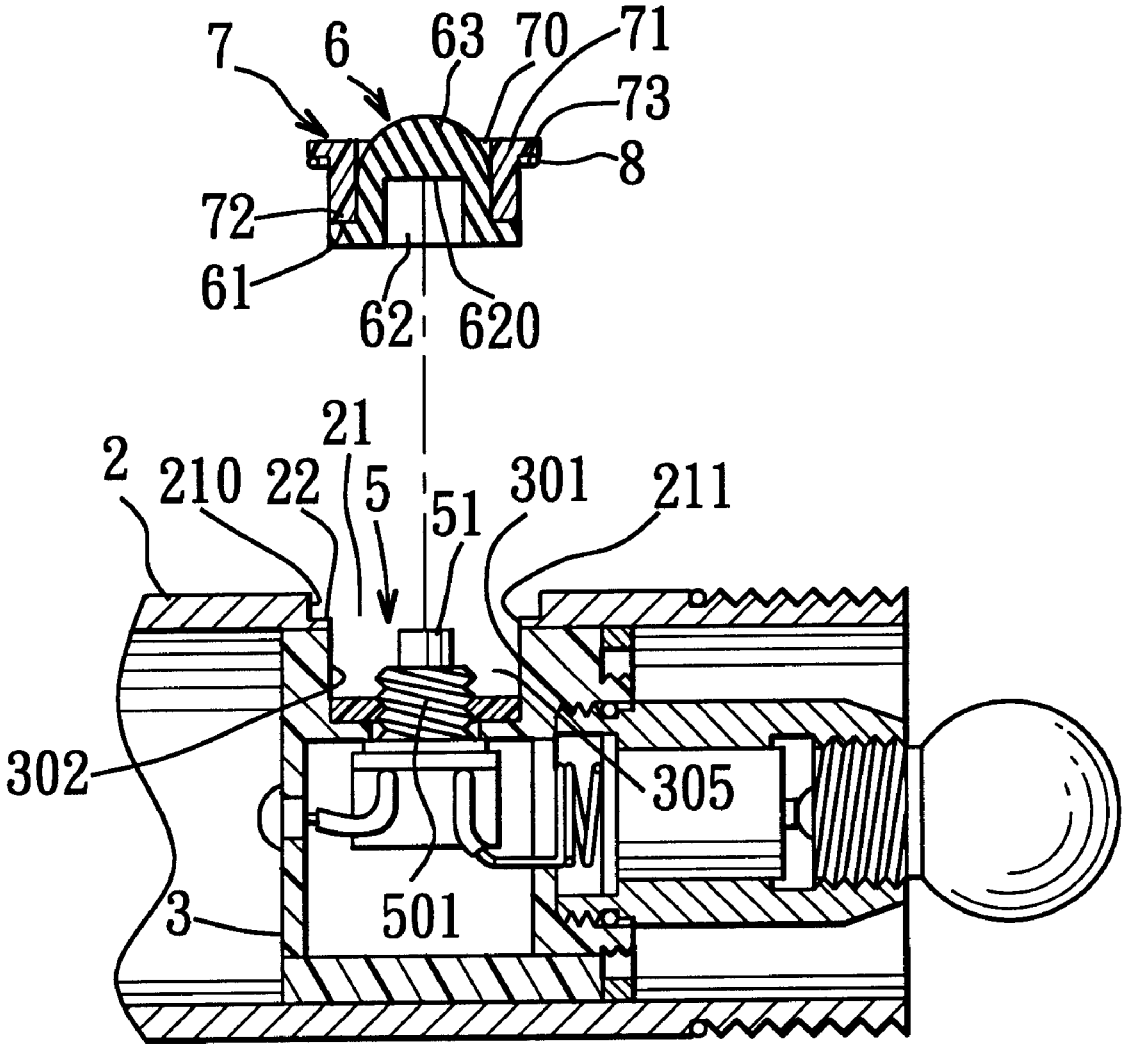

As illustrated, the barrel 2 is formed with a radial switch opening 21 (see FIG. 6).

The switching device includes a switch housing 3 mounted in the barrel 2 and formed with a radial button hole 301 that is aligned with the radial switch opening 21 and that has a large-diameter hole portion 302 proximate to the switch opening 21, a small-diameter hole portion 303 that is distal to the switch opening 21, and an annular shoulder 304 defined between the large and small-diameter hole portions 302,303. Thus, the shoulder 304 is located at one end of the button hole 301 distal to the switch opening 21 in the barrel 2. The large-diameter hole portion 302 of the button hole 301 is confined by a hole-defining surface.

A push-button switching element 5 is mounted in the switch housing 3, and has a button-confining sleeve 501 and a button 51 movably confined by the button-confining sleeve 501. The button-confining sleeve 501 and the button 51 extend through the small-diameter hole portion 303 and into the large-diameter hole portion 302 of the button hole 301. The button-confining sleeve 501 cooperates with the hole-defining surface confining the large-diameter hole portion 302 of the button hole 301 to form a first annular clearance 305 (see FIG. 6).

A resilient sealing member 6 is disposed in the first annular clearance 305, and has an operating portion 63 that projects into the switch opening 21, a tubular portion 62 that extends from the operating portion 63 and that defines a cavity 620 to receive the button 51 and the button-confining sleeve 501 therein, and a peripheral flange portion 61 that extends from one end of the tubular portion 62 proximate to the shoulder 304 and that extends to the hole-defining surface confining the large-diameter hole portion 302 of the button hole 301. The tubular portion 62 of the sealing member 6 cooperates with the hole-defining surface confining the large-diameter hole portion 302 of the button hole 301 to form a second annular clearance 306 (see FIG. 3). Preferably, the resilient sealing member 6 is made of an elastomeric material.

A retaining ring 7 includes an annular portion 72 fittingly disposed in the second annular clearance 306 around the tubular portion 62 of the sealing member 6 so as to urge the tubular portion 62 to contact tightly the button-confining sleeve 501 of the switching element 5, and so as to urge the peripheral flange portion 61 of the sealing member 6 toward the shoulder 304. The annular portion 72 of the retaining ring 7 defines a through hole 70 to permit extension of the operating portion 63 outwardly of the switch opening 21. The retaining ring 7 can be made of a hard material, such as plastics or metal.

The waterproof switching device further includes a nut fastener 90 disposed in the large-diameter hole portion 302 of the button hole 301 between the peripheral flange portion 61 of the sealing member 6 and the shoulder 304. The fastener 90 engages threadedly an externally threaded portion of the button-confining sleeve 501 such that the retaining ring 7 urges the peripheral flange portion 61 of the sealing member 6 to contact tightly the nut fastener 90.

In this embodiment, the switch opening 21 has a large-diameter opening portion 210 proximate to an outer barrel surface of the barrel 2, a small-diameter opening portion 211 proximate to an inner barrel surface of the barrel 2, and a first annular flange 22 defined between the large and small-diameter opening portions 210,211 adjacent to the inner barrel surface. The large-diameter opening portion 210 is confined by an opening-defining surface. The annular portion 72 of the retaining ring 7 extends through the small-diameter opening portion 211 and into the large-diameter opening portion 210 of the switch opening 21. The retaining ring 7 has a second annular flange 73 that extends radially and outwardly from an upper end 71 thereof and into the opening-defining surface confining the large-diameter opening portion 210 in such a manner that the first and second annular flanges 22,73 cooperatively form an annular groove therebetween. A rubber sealing ring 8 is disposed in the annular groove around the retaining ring 7 to establish a watertight seal between the barrel 2 and the retaining ring 7.

Preferably, the switch housing 3 includes a first housing portion 30 defining the button hole 301 therethrough, and a second housing portion 31 that cooperates with the first housing portion 30 to form an accommodation chamber 308 (see FIG. 3) therebetween in communication with the button hole 301. The switching element 5 further includes a switching seat 50 disposed in the chamber 308. The button-confining sleeve 501 is mounted securely on the switching seat 50. Two conductive terminals 500 have two inner ends embedded in the switching seat 50 proximate to the button 51, and two outer ends that extend outwardly from the switching seat 50. The first housing portion 30 is further formed with a threaded hole 300 in communication with the chamber 308. A bulb assembly 4 includes a bulb mounting tube 42 that has a first portion 420 threadedly mounted to the hole 300 in the first housing portion 30, and a second portion 421 within which a bulb (L) is mounted. A conductive spring retainer 41 is disposed in the first portion 420 of the tube 42 and in contact with the bulb (L). A spring 40 is disposed in the spring retainer 41, and extends through the hole 300 in the first housing portion 30 to connect electrically with one of the outer ends of the conductive terminals 500. The other one of the outer ends of the conductive terminals 500 is exposed outwardly from the chamber 308 and is adapted to contact a battery unit (not shown) when the latter is disposed in the barrel 2. The button 5 is operable to permit electrical connection between the inner ends of the conductive terminals 500 so as to light the bulb (L).

Note that during assembly of the flashlight of the present invention, the switch housing 3 is inserted into the barrel 2 from a rear opening thereof, while the bulb mounting tube 42 of the bulb assembly 4 is inserted from a front opening thereof and is threaded to the first housing portion 30. After mounting of the nut fastener 90 and the retaining ring 7 in the button hole 301 of the switch housing 3, the switch housing 3 is prevented from axial displacement relative to the barrel 2 so as to immobilize the housing 3 in the barrel 2. In addition, the sealing ring 8 employed in the switch device of the flashlight of the present invention provides an enhanced waterproofing effect.

With this invention thus explained, it is apparent that numerous modifications and variations can be made without departing from the scope and spirit of this invention. It is therefore intended that this invention be limited only as indicated in the appended claims.

I claim:

1. A flashlight comprising:

a barrel formed with a radial switch opening; and a waterproof switching device that includes a switch housing mounted in said barrel and formed with a radial button hole that is aligned with said radial switch opening and that has a large-diameter hole portion proximate to said switch opening, and a small-diameter hole portion that is distal to said switch opening, thereby forming a shoulder at one end of said button hole that is distal to said switch opening, said large-diameter hole portion being confined by a hole-defining surface, a push-button switching element mounted in said switch housing, and having a button-confining sleeve and a button movably confined by said button-confining sleeve, said button-confining sleeve and said button extending through said small-diameter hole portion and into said large-diameter hole portion of said button hole, said button-confining sleeve cooperating with said hole-defining surface confining said large-diameter hole portion of said button hole to form a first annular clearance, a resilient sealing member disposed in said first annular clearance and having an operating portion that projects into said switch opening, a tubular portion that extends from said operating portion and that encloses said button and said button-confining sleeve, and a peripheral flange portion that extends from one end of said tubular portion proximate to said shoulder and that extends to said hole-defining surface confining said large-diameter hole portion of said button hole, said tubular portion of said sealing member cooperating with said hole-defining surface confining said large-diameter hole portion of said button hole to form a second annular clearance, and a retaining ring fittingly disposed in said second annular clearance so as to urge said tubular portion of said sealing member to contact tightly said button-confining sleeve of said switching element, and so as to urge said peripheral flange portion of said sealing member toward said shoulder.

2. The flashlight as defined in claim 1, wherein said button-confining sleeve is threaded externally, and said waterproof switching device further includes a nut fastener that is disposed in said large-diameter hole portion of said button hole between said peripheral flange portion of said sealing member and said shoulder, and that engages threadedly said button-confining sleeve, said retaining ring urging said peripheral flange portion of said sealing member to contact tightly said nut fastener.

3. The flashlight as defined in claim 1, wherein said barrel has outer and inner barrel surfaces, said switch opening having a large-diameter opening portion proximate to said outer barrel surface, and a small-diameter opening portion proximate to said inner barrel surface, thereby forming a first annular flange adjacent to said inner barrel surface, said large-diameter opening portion being confined by an opening-defining surface, said retaining ring extending through said small-diameter opening portion and into said large-diameter opening portion of said switch opening, and being formed with a second annular flange that extends to said opening-defining surface confining said large-diameter opening portion.

4. The flashlight as defined in claim 3, wherein said first and second annular flanges cooperatively form an annular groove therebetween, said waterproof switching device further comprising a sealing ring disposed in said annular groove around said retaining ring to establish a watertight seal between said barrel and said retaining ring.

* * * * *